US005367870A

United States Patent [19]

Vollmer

[11] Patent Number: 5,367,870

[45] Date of Patent: Nov. 29, 1994

[54] GAS AND STEAM TURBINE SYSTEM

[75] Inventor: Wolfgang Vollmer, Erlangen, Germany

[73] Assignee: Siemens Aktiengesellschaft, Munich, Germany

[21] Appl. No.: 153,181

[22] Filed: Nov. 16, 1993

[30] Foreign Application Priority Data

May 16, 1991 [DE] Germany ..... 4116065

[51] Int. Cl.[5] ..... F02C 3/26; F02C 6/18

[52] U.S. Cl. ..... 60/39.182; 60/39.464

[58] Field of Search ..... 60/39.12, 39.182, 39.464, 60/39.511

[56] References Cited

U.S. PATENT DOCUMENTS 2,055,385 9/1936 Noack ..... 60/39.182
2,663,146 12/1953 Legendre ..... 60/39.182
3,095,699 7/1963 Baver .
3,314,231 4/1967 Hochmuth .
4,976,101 12/1990 Schiffers ..... 60/39.12

FOREIGN PATENT DOCUMENTS 2030500 11/1970 France .
2107489 5/1972 France .
62-048794 3/1987 Japan .
904536 8/1962 United Kingdom .

*Primary Examiner*—Louis J. Casaregola
*Attorney, Agent, or Firm*—Herbert L. Lerner; Laurence A. Greenberg

[57] ABSTRACT

A gas and steam turbine system includes a coal mill. A steam turbine has a water-steam loop. A gas turbine has an exhaust gas side supplying exhaust gas. A first heat exchanger is connected to the exhaust gas side of the gas turbine. A steam generator is connected downstream of the exhaust gas side of the gas turbine and upstream of the steam turbine in the water-steam loop for generating steam for the steam turbine. The steam generator has a furnace system connected downstream of the coal mill for supplying flue gas flowing through the steam generator. A second heat exchanger is connected to the coal mill. A first adjustable fractional quantity of the exhaust gas from the gas turbine after being cooled in the first heat exchanger, is delivered to the furnace system as combustion air. A second adjustable fractional quantity of the cooled exhaust gas is delivered to the second heat exchanger for heating air for the coal mill. A third adjustable fractional quantity of the cooled exhaust gas is admixed with the flue gas from the furnace system.

4 Claims, 1 Drawing Sheet

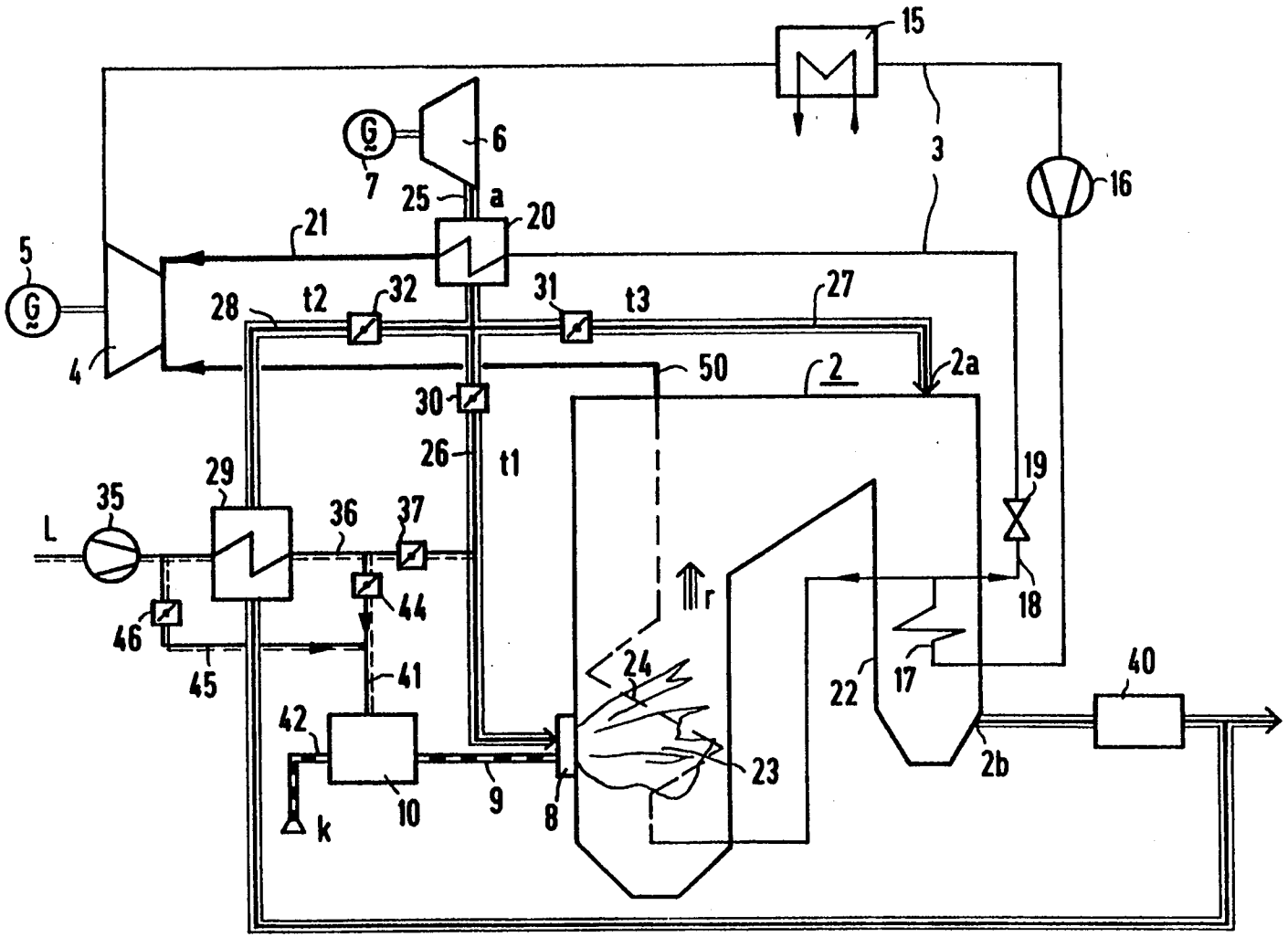
16
15
3
27
2a
2
19
18
17
2b
40
22
23
24
r
50
t3
31
20
6
a
25
7
G
32
21
t2
28
4
5
G
30
26
t1
8
9
37
44
41
10
36
42
k
29
45
46
35
L

GAS AND STEAM TURBINE SYSTEM

CROSS-REFERENCE TO RELATED APPLICATION

This application is a Continuation of International Application Serial No. PCT/DE91/00952, filed Dec. 6, 1991.

BACKGROUND OF THE INVENTION

1. Field of the Invention

The invention relates to a gas and steam turbine system, with a steam generator connected downstream of a gas turbine on the exhaust gas side for producing steam for a steam turbine in a water-steam loop, in which the steam generator includes a furnace system connected downstream of a coal mill.

In the planning and construction of a gas and steam turbine system, and especially when a gas turbine system is coupled to an existing steam turbine system with a furnace system, the mutually dependent capacities of the gas turbine and the steam turbine and also of the steam generator must be adapted to one another in order to attain high overall total efficiency. The total efficiency becomes higher as the gas turbine is operated longer at full load. However, since in such a system the exhaust gas of the gas turbine is typically used as combustion air for the furnace system of the steam generator, any change in the steam generator capacity, instance from a reduction in the flame temperature of the furnace system, results in an incorrect ratio between the quantity of gas turbine exhaust gas and the requisite quantity of air or oxygen of the furnace system. As a result, the efficiency of the system can be optimized only to a limited extent, especially in the partial-load range.

2. Summary of the Invention

It is accordingly an object of the invention to provide a gas and steam turbine system, which overcomes the hereinafore-mentioned disadvantages of the heretofore-known methods and devices of this general type and which attains the highest possible total efficiency in all operating states, when retrofitting an existing steam turbine system by adding a turbine. Maximal utilization of existing component assemblies should be permitted in the process.

With the foregoing and other objects in view there is provided, in accordance with the invention, a gas and steam turbine system, comprising a coal mill; a steam turbine having a water-steam loop; a gas turbine having an exhaust gas side supplying exhaust gas; a first heat exchanger connected to the exhaust gas side of the gas turbine; a steam generator connected downstream of the exhaust gas side of the gas turbine and upstream of the steam turbine in the water-steam loop for generating steam for the steam turbine, the steam generator having a furnace system connected downstream of the coal mill for supplying flue gas flowing through the steam generator; a second heat exchanger connected to the coal mill; means for delivering a first adjustable fractional quantity of the exhaust gas from the gas turbine after being cooled in the first heat exchanger, to the furnace system as combustion air; means for delivering a second adjustable fractional quantity of the cooled exhaust gas to the second heat exchanger for heating air for the coal mill; and means for admixing a third adjustable fractional quantity of the cooled exhaust gas with the flue gas from the furnace system.

In accordance with another feature of the invention, in order to produce additional steam for the steam turbine, the heat exchanger through which the exhaust gas from the gas turbine flows is connected into the water-steam loop of the steam turbine. The exhaust gas from the gas turbine is advantageously cooled to the highest temperature permitted by the structure of the existing flue gas conduits of the gas turbine system.

In accordance with a further feature of the invention, in order to enrich the combustion air for the furnace system with oxygen, a fraction of the air heated in the second heat exchanger is delivered to the first fractional quantity of the cooled exhaust gas.

In accordance with a concomitant feature of the invention, in order to regulate the temperature in the coal mill, cold air is admixed with the air heated in the second heat exchanger for the coal mill.

The advantages attained with the invention are particularly that on one hand by cooling down the exhaust gases from the gas turbine in a heat exchanger, overheating of existing flue gas conduits of the gas turbine system is reliably avoided, and on the other hand, by splitting the cooled exhaust gases into regulatable fractional quantities, additional utilization of the heat contained in the exhaust gases for the total process and therefore a high total efficiency of the system regardless of the operating state are attained.

Other features which are considered as characteristic for the invention are set forth in the appended claims.

Although the invention is illustrated and described herein as embodied in a gas and steam turbine system, it is nevertheless less not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The figure is a diagrammatic and schematic circuit diagram showing a gas and steam turbine system with splitting of exhaust gases from the gas turbine into three regulatable fractional flows.

DESCRIPTION OF THE PREFERRED EMBODIMENTS

Referring now to the single figure of the drawing in detail, there is seen a gas and steam turbine system which includes a steam generator 2, a steam turbine 4 having a coupled generator 5 and being connected into a water-steam loop 3, and a gas turbine 6 having a coupled generator 7 and being connected upstream of the steam generator 2. The steam generator 2 includes a furnace system 8, which is connected to a coal mill 10 through a fuel line 9.

The water-steam loop 3 of the steam turbine 4 is shown in simplified form, and incorporated in the water-steam loop 3 are a condenser 15, a pump 16 following the condenser 15, and a preheater 17 disposed in the steam generator 2. An outlet side of the preheater 17 is connected through a first branch 18, into which a valve 19 is incorporated, to a first heat exchanger 20 that is heated by hot exhaust gas a from the gas turbine 6. The preheater 17 is also connected through a second branch 22 to a heater 24 disposed in the steam generator 2 in the region of a furnace 23.

The heat exchanger 20 has an outlet side connected to the steam turbine 4 through a steam line 21. The heat exchanger 20 has a primary side connected into an exhaust gas line 25 that is in turn connected to the gas turbine 6.

In order to deliver a first fractional quantity t1 of the exhaust gas a from the gas turbine 6 to the furnace system 8, a first fractional flow line 26 is connected to the exhaust gas line 25 and discharges into the furnace system 8. The exhaust gas line 25 has a second fractional flow line 28, into which a second heat exchanger 29 is incorporated. The exhaust gas line 25 also communicates through a third fractional flow line 27 with an inlet 2*a* of the steam generator 2. Incorporated in the fractional flow lines 26, 27 and 28 are respective valves 30, 31 and 32, which by way of example are throttle valves or other regulating devices. The valves 30, 31 and 32 may be actuated by non-illustrated motors.

During operation of the gas and steam turbine system, the hot exhaust gas a flowing out of the gas turbine 6 is cooled down to approximately 400° C. Downstream of the heat exchanger 20 in terms of the flow direction of the exhaust gas a, the exhaust gas a is split into three adjustable fractional quantities, namely the first fractional quantity t1 second and third and fractional quantities t2 and t3, respectively. The first fractional quantity t1 flowing through the first fractional flow line 26 is adjusted to the combustion air demand of the furnace system 8, or in other words it is adjusted especially as a function of the operating state of the system. Compressed air L from an air compressor 35, which is preheated in the heat exchanger 29, may be admixed with the first fractional quantity t1. To that end, the air compressor 35 is connected to the first fractional flow line 26 through an air line 36 connected to the secondary side of the heat exchanger 29. In order to adjust the requisite air quantity, a valve 37 is incorporated into the air line 36.

If the load is decreasing, with an attendant reduced requirement for combustion air for the furnace system 8, the fraction of the exhaust gas a that is not required for the furnace system 8 is carried through the fractional flow lines 27 and 28 on one hand into the steam generator 2 and on the other hand through the second heat exchanger 29. In the process, the third fractional quantity t3 of the exhaust gas a flowing through the third fractional flow line 27 is admixed with flue gas r produced in the furnace system 8. The flue gas, r and the third fractional quantity t3 of the exhaust gas a leave the steam generator 2 through an outlet 2*b* thereof and are carried through a gas filter 40 in the direction of a non-illustrated chimney.

The adjustable second fractional quantity t2 of the exhaust gas a carried through the fractional flow line 28 heats the air L, flowing through the air line 36, in the heat exchanger 29 and is then admixed, downstream of the gas filter 40, with the flue gas r flowing out of the steam generator 2.

The heat L from the air compressor 36, heated in the heat exchanger 29 by the second fractional quantity t2, flows into the coal mill 10 through a branch 41 of the air line 36. There it serves on one hand as a heating medium for drying the coal k supplied to the coal mill 10 through a coal line 42 and on the other hand serves as a vehicle for delivering the coal k, ground in the coal mill 10, to the furnace system 8 through the fuel line 9. A cold air line 45, into which a valve 46 is incorporated and which is connected to the air line 36 upstream of the heat exchanger 29, discharges into the branch 41 which begins at the air line 36 and into which a valve 44 is incorporated. The temperature of the air L for the coal mill 10 is adjusted by admixing a quantity of cold air that can be adjusted by means of the valve 46 with the heated air L from the heat exchanger 29.

The flue gas r from the furnace system 8 and the third fractional quantity t3 of the exhaust gas a flowing into the steam generator 2 through the third fractional flow line 27 serve to produce steam for the steam turbine 4. To that end, water is pumped out of the condenser 15, through the pump 16 and into the preheater 17 that is heated by the flue gas r and the exhaust gas a, and is preheated there. The heated water flowing through the branch 22 is evaporated and superheated by heating surfaces in the heater 24 that are heated by the hot flue gases r from the furnace system 8. The superheated steam is delivered to the steam turbine 4 through a steam line 50. The heated water flowing through the branch 18 is likewise evaporated and superheated in the heat exchanger 20 and delivered to the steam turbine 4. There the superheated steam loses pressure and is subsequently condensed in the condenser 15.

By splitting the cooled exhaust gases a from the gas turbine 6 into three adjustable fractional quantities t1, t2 and t3 in accordance with the invention, on one hand the gas turbine 6 is decoupled from the requirements made of the furnace system in terms of the quantity of air required at various operating states. On the other hand, the steam generator 2 and therefore the steam process can be operated regardless of the load state of the gas turbine 6.

I claim:

1. A gas and steam turbine system, comprising:

a coal mill;

a steam turbine having a water-steam loop;

a gas turbine having an exhaust gas side supplying exhaust gas;

a first heat exchanger connected to the exhaust gas side of said gas turbine; a steam generator connected downstream of the exhaust gas side of said gas turbine and upstream of said steam turbine in said water-steam loop for generating steam for said steam turbine, said steam generator having a furnace system connected downstream of said coal mill for supplying flue gas flowing through said steam generator, and said steam generator having an inlet;

a second heat exchanger connected to said coal mill;

means for delivering a first adjustable fractional quantity of the exhaust gas from said gas turbine after being cooled in said first heat exchanger, to said furnace system as combustion air;

means for delivering a second adjustable fractional quantity of the cooled exhaust gas to said second heat exchanger for heating air for said coal mill; and means for delivering a third adjustable fractional quantity of the cooled exhaust gas to said inlet of said steam generator for admixing said third fractional quantity with the flue gas from said furnace system.

2. The gas and steam turbine system according to claim 1, wherein said heat exchanger through which the exhaust gas from said gas turbine flows is connected into said water-steam loop of said steam turbine.

3. The gas and steam turbine system according to claim 1, including means for delivering a fraction of the air heated in said second heat exchanger to the first fractional quantity of the cooled exhaust gas.

4. The gas and steam turbine system according to claim 3, including means for admixing cold air with the air heated in said second heat exchanger for said coal mill.

* * * * *